US008201433B2

(12) United States Patent
Kanie

(10) Patent No.: US 8,201,433 B2
(45) Date of Patent: Jun. 19, 2012

(54) TOOL SET AND PRESS-FORMING METHOD

(75) Inventor: Yoji Kanie, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 637 days.

(21) Appl. No.: 12/368,579

(22) Filed: Feb. 10, 2009

(65) Prior Publication Data

US 2009/0211327 A1 Aug. 27, 2009

(30) Foreign Application Priority Data

Feb. 27, 2008 (JP) ..... 2008-046203

(51) Int. Cl.
*B21D 28/00* (2006.01)
*B21D 22/21* (2006.01)

(52) U.S. Cl. ..... 72/335; 72/350

(58) Field of Classification Search ..... 72/325–339, 72/350, 355.2, 355.4, 358, 382, 705; 29/897.2
See application file for complete search history.

(56) References Cited

U.S. PATENT DOCUMENTS

| | | | | |
|---|---|---|---|---|
| 2,031,024 | A * | 2/1936 | Ahlquist | 72/330 |
| 2,212,886 | A * | 8/1940 | Ruland | 72/330 |
| 2,348,875 | A * | 5/1944 | Beard | 72/327 |
| 2,383,584 | A * | 8/1945 | Beishline et al. | 72/335 |
| 6,293,134 | B1 * | 9/2001 | Johnson | 72/335 |

FOREIGN PATENT DOCUMENTS

| | | |
|---|---|---|
| JP | 52-51347 U | 11/1977 |
| JP | 57-170833 | 10/1982 |
| JP | 59-46699 U | 3/1984 |
| JP | 61-269996 | 11/1986 |
| JP | 6-79696 | 3/1994 |
| JP | 8-150428 | 6/1996 |
| JP | 8-332529 | 12/1996 |
| JP | 9-47828 | 2/1997 |
| JP | 10-296690 | 11/1998 |
| JP | 2002-26362 | 1/2002 |
| JP | 2004-66315 | 3/2004 |
| JP | 2004-154913 | 6/2004 |
| JP | 2005-219140 | 8/2005 |
| JP | 2007-90400 | 4/2007 |

OTHER PUBLICATIONS

Office Action issued Nov. 18, 2010 in Japanese Patent Application No. 2008-046203 (with Partial English translation).
Office Action issued Jun. 21, 2011 in Japanese Patent Application No. 2008-46203 (with Partial English translation).
Japanese Office Action issued on Dec. 6, 2011 in Japanese Patent Application No. 2008-046203 filed Feb. 27, 2008 (with Partial English Translation).

* cited by examiner

*Primary Examiner* — Teresa M Ekiert
(74) *Attorney, Agent, or Firm* — Oblon, Spivak, McClelland, Maier & Neustadt, L.L.P.

(57) ABSTRACT

A die on which a fabricated body to be press-formed is mounted includes a mounting surface on which the fabricated body is mounted, a punch that forms a hole in the fabricated body, a first receiving portion that at least partially receives the punch, and a second receiving portion which is formed in the mounting surface and receives a deformed portion of the fabricated body that is formed by the pressure of the punch on the fabricated body.

6 Claims, 7 Drawing Sheets

| θ | ~30 | 30~60 | 60~ |
|---|---|---|---|
| EFFECT | ○ | ○ | × |
| DURABILITY | × | ○ | ○ |

TOOL SET AND PRESS-FORMING METHOD

INCORPORATION BY REFERENCE

The disclosure of Japanese Patent Application No. 2008-046203 filed on Feb. 27, 2008, including the specification, drawings and abstract is incorporated herein by reference in its entirety.

BACKGROUND OF THE INVENTION

1. Field of the Invention

The invention relates to a die, a tool set, and a press-forming method.

2. Description of the Related Art

Technology related to movable bodies such as vehicles is becoming more and more electronically oriented. As a result, a variety of electronic components are currently being installed in vehicles. For example, some vehicles are equipped with distance measuring equipment referred to as sonar. Incorporating sonar into a vehicle enables the driver of the vehicle to be notified of the distance between the vehicle and an obstacle, thereby enabling the driver of the vehicle to safely maneuver the vehicle before reaching the obstacle. This technology also enables the driver of the vehicle to avoid a collision with an unexpected obstacle.

In a vehicle equipped with sonar, the sonar equipment is in some cases installed in an opening that has been formed in a bumper of the vehicle beforehand. This bumper forms a portion of the exterior of the vehicle and thus affects the external appearance of the vehicle. Therefore, when forming holes in the bumper, it must be done without detracting from the appearance of the bumper.

Incidentally, Japanese Patent Application Publication No. 8-150428 (JP-A-8-150428) describes technology relating to press-forming that enables a through-hole having a tapered shape to be formed by a single press-forming operation.

A hole is formed in a bumper by pressing the bumper, which is mounted on a die, with a punch. However, in this case, burrs may form on the surface of the bumper. Incidentally, the burrs are formed by the bumper being deformed from the pressure of the punch on the bumper. When burrs form in the surface of the bumper, they may detract from the appearance of the bumper. In this case, the bumper may need to be reworked in order to improve its appearance. For example, the appearance of the bumper may need to be improved by manually deburring the bumper or attaching a seal member to hide the burrs on the bumper or the like.

SUMMARY OF THE INVENTION

This invention thus provides technology for inhibiting the appearance of a fabricated body from being adversely affected by burrs formed when the fabricated body is press-formed.

A first aspect of the invention relates to a die on which a fabricated body to be press-formed is mounted. This die includes a mounting surface on which the fabricated body is mounted, a first receiving portion that at least partially receives a punch that forms a hole in the fabricated body, and a second receiving portion which is formed in the mounting surface and receives a deformed portion of the fabricated body that is formed by the pressure of the punch on the fabricated body.

In this aspect, the second receiving portion receives the deformed portion (i.e., the burr) of the fabricated body. Therefore, a deformed portion (i.e., a burr) of the fabricated body will not form on the upper surface of the fabricated body. Hence, it is possible to inhibit the appearance of the fabricated body from being adversely affected.

A second aspect of the invention relates to a press-forming tool set. This press-forming tool set includes a die on which a fabricated body is mounted, a punch that forms a hole in the fabricated body, a mounting surface that is formed on the die and on which the fabricated body is mounted, a first receiving portion which is formed in the die and at least partially receives the punch, and a second receiving portion which is formed in the mounting surface and receives a deformed portion of the fabricated body that is formed by the pressure of the punch on the fabricated body.

A third aspect of the invention relates to a press-forming method for forming a fabricated body using a die and a punch. This method includes mounting the fabricated body on a mounting surface of the die, pressing the fabricated body mounted on the die with the punch arranged in a position corresponding to a first receiving portion formed in the die, and receiving a deformed portion of the fabricated body, which is formed by the pressure of the punch on the fabricated body, in a second receiving portion formed in the mounting surface of the die.

A fourth aspect of the invention relates to a method of manufacturing a bumper having a hole using a die and a punch. This method includes mounting the bumper on a mounting surface of the die, pressing the bumper mounted on the die with a punch arranged in a position corresponding to a first receiving portion formed in the die, and receiving a deformed portion of the bumper, which is formed by the pressure of the punch on the bumper, in a second receiving portion formed in the mounting surface of the die.

These aspects make it possible to inhibit the appearance of a fabricated body from being adversely affected by burrs formed on the fabricated body when the fabricated body is press-formed.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF EMBODIMENTS

Figure 1:
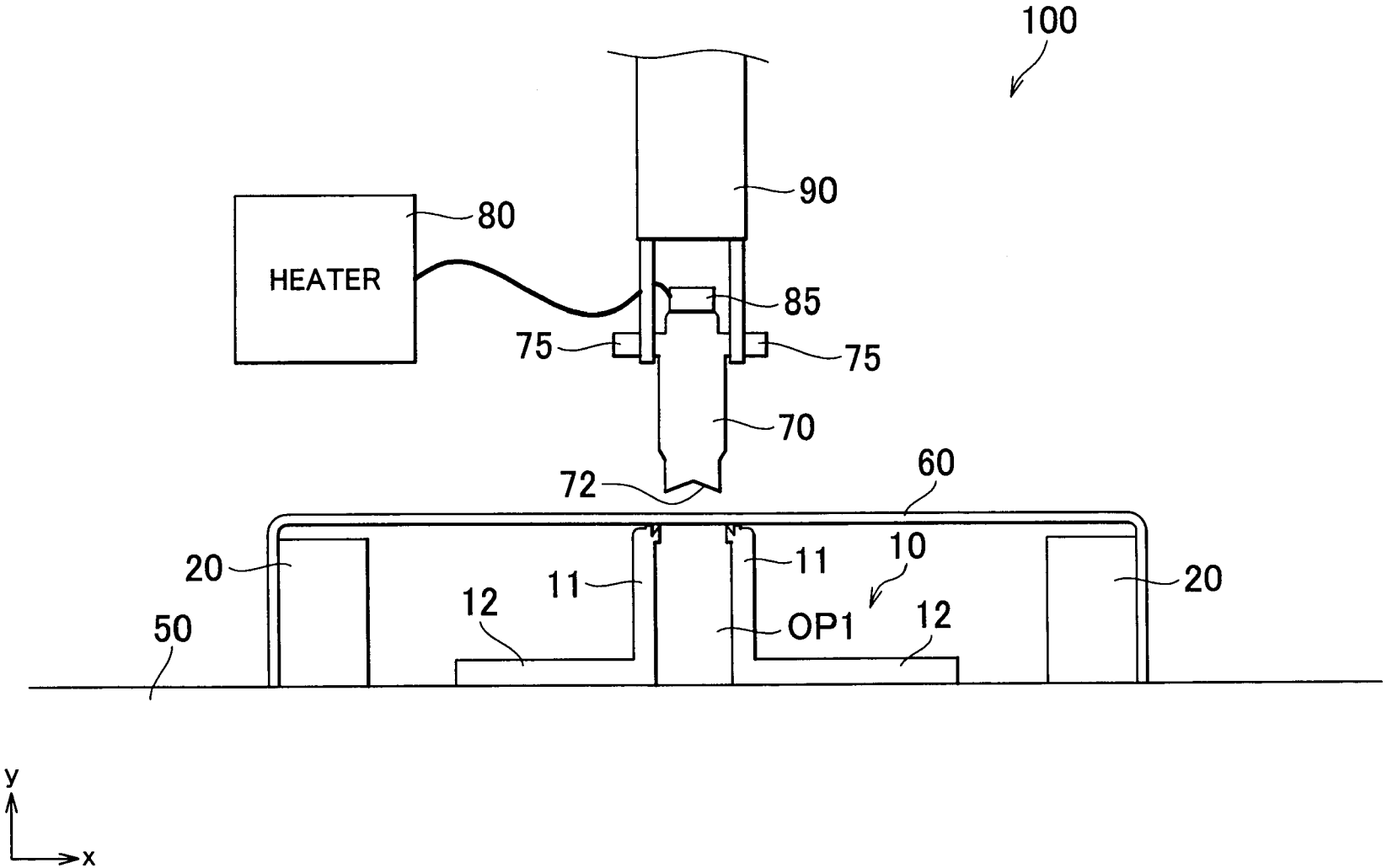
FIG. 1 is a schematic view showing a frame format of the structure of a press-forming apparatus according to a first example embodiment of the invention.

Example embodiments of the present invention will be described in greater detail below with reference to the accompanying drawings. Incidentally, the example embodiments have been simplified to facilitate the description. The drawings are also simplified so the technical scope of the invention is not to be construed as being limited or narrow based on the description of the drawings. The drawings are solely to illustrate technical points and do not reflect the accurate sizes and the like of the elements illustrated. Also, like elements will be denoted by like reference characters and redundant descriptions will be omitted. Terminology indicative of direction, such as up, down, left, and right, are used with respect to the drawings as viewed from the front.

First, a first example embodiment of the invention will be described with reference to FIGS. 1 to 8. As shown in FIG. 1, a die 10 and a punch 70 are mounted on a press-forming apparatus 100. Part of a bumper 60 that is arranged between the die 10 and the punch 70 is punched out by the punch 70 being partially inserted into an opening (i.e., a receiving portion) OP1 formed in the die 10. As a result, an opening that corresponds to the shape of the opening OP1 is formed in the bumper 60. Incidentally, the sectional shape of a lower end portion 70*a* (see FIG. 2) of the punch 70 resembles the shape of the opening OP1. Also, the die 10 is a tool (i.e., a base part) manufactured by die molding. The punch 70 is a tool (i.e., a cutting part) also manufactured by die molding.

As shown in FIG. 1, the die 10 is fixed by screws, not shown, to a stage 50 of the press-forming apparatus 100. The die 10 has a base 12 and a cylindrical portion 11. The base 12 is mounted on the stage 50. The cylindrical portion 11 has the opening OP1 that partially receives the punch 70.

The punch 70 is attached to a rod 90 of a hydraulic cylinder, not shown, of the press-forming apparatus 100. The punch 70 is a rod-shaped member with a cutter blade formed on a lower end surface 72. Incidentally, the method by which the punch 70 is attached to the rod 90 is arbitrary and may be determined as appropriate.

The bumper 60 is arranged between the die 10 and the punch 70. The bumper 60 is positioned in a predetermined position on the stage 50 by positioning members 20 that are fixed in predetermined locations on the stage 50 beforehand. Fixing the die 10 and the positioning members 20 on the stage 50 in predetermined positions beforehand enables the fabricating position of the bumper 50 to be precisely set. Incidentally, the initial position of the punch 70 is set so that the punch 70 can be partially received in the opening OP1 of the die 10 in response to thrust transmitted from the hydraulic cylinder (i.e., such that when the hydraulic cylinder drives the punch 70 downward, the punch 70 will be partially thrust into the opening OP1 of the die 10). Incidentally, the punch 70 is arranged facing the die 10. The bumper 60 is formed of resin using a mold.

As the punch 70 is received in the opening OP1 in response to thrust transmitted from the hydraulic cylinder (i.e., as the punch 70 is thrust into the opening OP1 by the hydraulic cylinder), part of the bumper 60 is punched out. In this way, an opening for mounting sonar equipment is formed in the bumper 60.

Incidentally, the press-forming apparatus 100 is a thermal press-forming apparatus. This press-forming apparatus 100 has a heater 80 which functions as a temperature controller. The heater 80 has an output terminal 85 mounted on the upper surface of the punch 70. Press-forming when the temperature of the punch that physically contacts the bumper 60 is set at a predetermined temperature (such as 80 to 120° C.) makes it possible to maintain a good cut surface of the bumper 60 and reduces the amount of thrust necessary for press-forming.

Next, the structures of the punch 70 and the die 10 will be described with reference to FIGS. 2 to 4.

Figure 2:
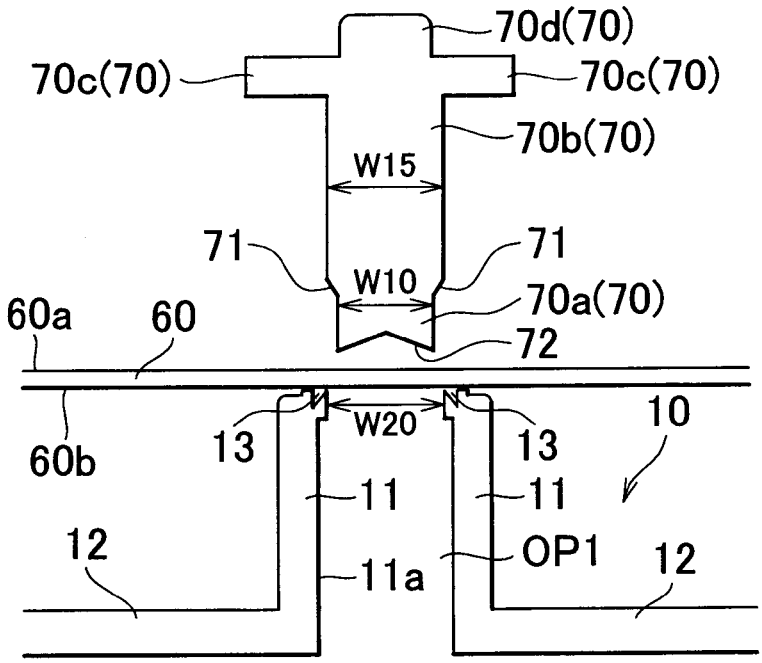
FIG. 2 is a view illustrating a press-forming process executed by the press-forming apparatus according to the first example embodiment of the invention.

As shown in FIG. 2, the punch 70 has a lower end portion 70*a*, a body portion 70*b*, a mounting portion 70, and a top portion 70*d*. The lower end portion 70*a* is being capable of partially received in the opening OP1 of the die 10. The width W10 of the lower end portion 70*a* is smaller than the width W20 of the opening OP1 of the die 10. The body portion 70*b* is not received in the opening OP1 of the die 10. The width W15 of the body portion 70*b* is larger than the width W20 of the opening OP1 of the die 10.

The width W10 of the lower end portion 70*a* is narrower than the width W15 of the body portion 70*b*. A pressing surface 71 is formed at the boundary portion between the lower end portion 70*a* and the body portion 70*b*. During press-forming, the pressing surface 71 presses on the edge portion of the bumper 60 that defines the opening formed in the bumper 60.

Figure 3:
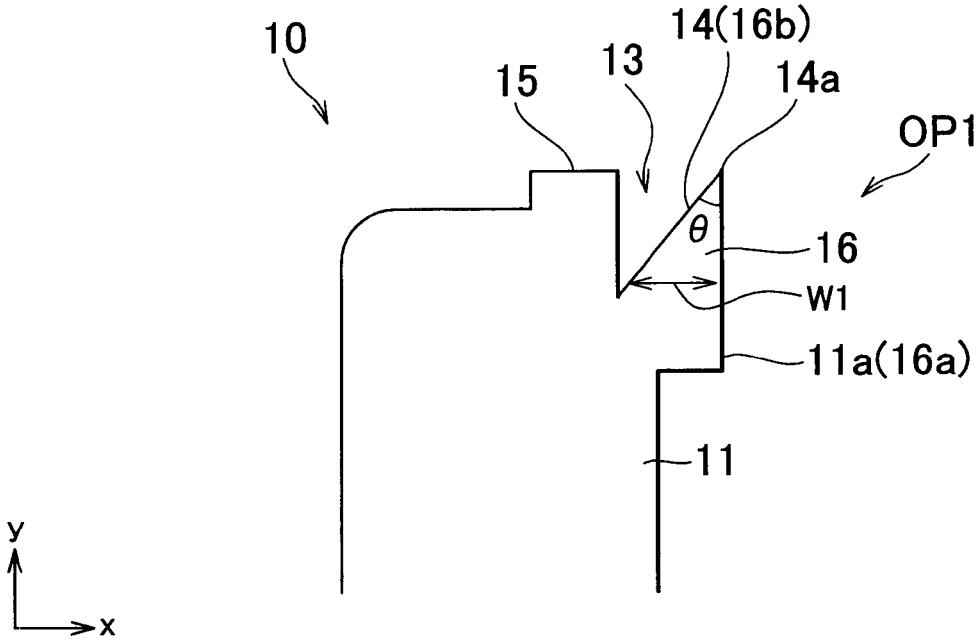
FIG. 3 is a detailed view showing a frame format of the structure of a die according to the first example embodiment of the invention.
Figures 4, 5:
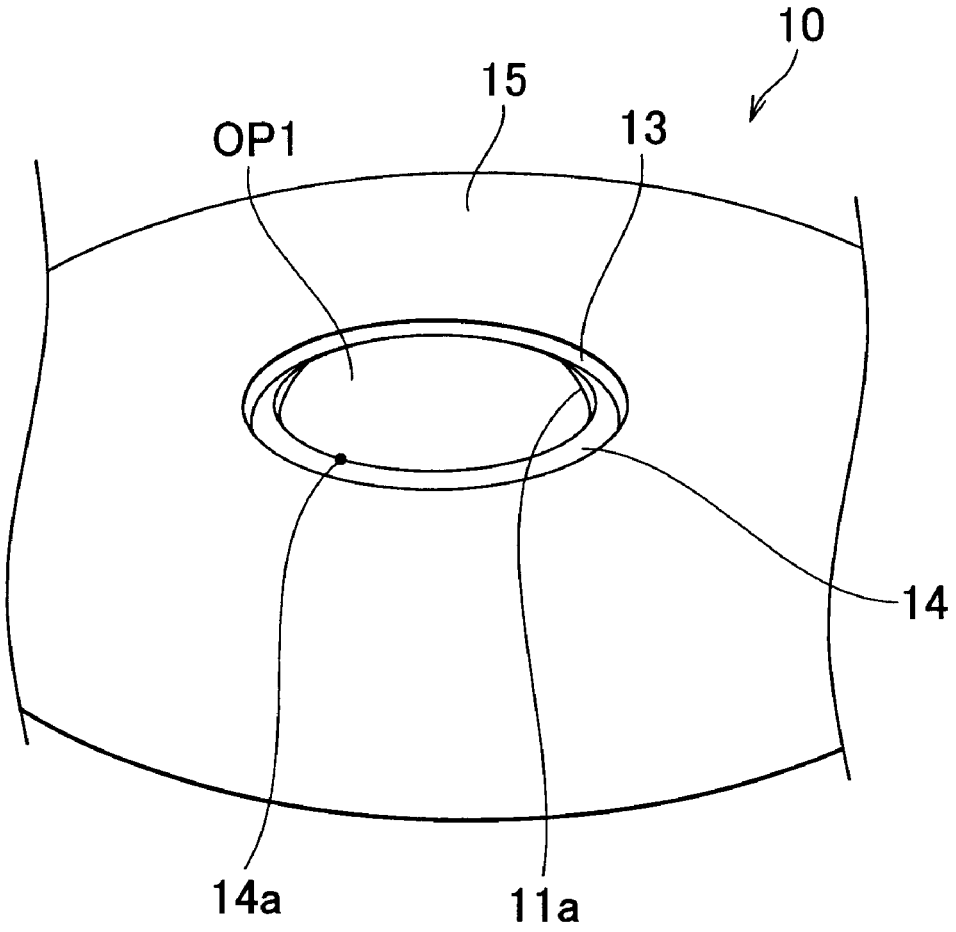
FIG. 4 is a perspective view showing a frame format of the die according to the first example embodiment of the invention.
FIG. 5 is a chart showing angle of inclination setting conditions according to the first example embodiment of the invention.

As shown in FIGS. 3 and 4, a concave portion (i.e., receiving portion) 13 is formed in an upper surface (i.e., a mounting surface) of the cylindrical portion 11. A slanted surface 14 that slants upward (to the punch 70 side or the bumper 60 side) toward the opening OP1 side is formed on the concave portion 13. The slanted surface 14 surrounds the opening OP1 as shown in FIG. 4. An inner area 14*a* of the slanted surface 14 is connected with an inside surface 11*a* of the cylindrical portion 11.

As shown in FIG. 3, the thickness W1 between the slanted surface 14 and the inside surface 11*a* of the cylindrical portion 11 becomes thinner toward the top (i.e., toward the punch 70 side or the bumper 60 side). Thus, from this perspective, it appears that a pointed protruding portion 16 is formed on the upper end of the cylindrical portion 11. Incidentally, an inside surface 16*a* of the protruding portion 16 corresponds to the inside surface 11*a* of the cylindrical portion 11, and an outside surface 16*b* of the protruding portion 16 corresponds to the slanted surface 14.

In this example embodiment, the angle (i.e., the angle of inclination) θ formed by the slanted surface 14 and the inside surface 11*a* of the cylindrical portion 11 is set so that it is between 30° and 60°, inclusive (in this example, the angle of inclination θ is set to 45°). As shown in FIG. 5, setting the angle of inclination θ in this way achieves an effect of inhibiting burrs from forming on the upper surface of the bumper 60 without losing durability of the die 10 (in FIG. 5 this effect is abbreviated to simply "EFFECT").

When the angle of inclination θ is less than 30°, the overall thickness W1 of the protruding portion 16 becomes thinner. In this case, the protruding portion 16 may crack prematurely when press-forming is performed. Therefore, the angle of inclination θ is preferably set to 30° or more to improve the durability of the die 10.

When the angle of inclination θ is greater than 60°, the overall thickness W1 of the protruding portion 16 becomes thicker. In this case, premature cracking of the protruding portion 16 when press-forming is performed is able to be suppressed. However, according to test results, the effect of inhibiting burrs from forming on the upper surface of the bumper 60 is not able to be sufficiently obtained.

Forming the angle of inclination θ between 30° and 60°, inclusive, makes it possible to achieve the effect of inhibiting burrs from forming on the upper surface of the bumper 60 without losing durability of the die 10 (in FIG. 5 this effect is abbreviated to simply "EFFECT" as described above). Incidentally, the angle of inclination θ may also be more preferably set to between 40° and 50°, inclusive.

Now the mechanism for inhibiting burrs from forming on the upper surface 60*a* of the bumper 60 will be described with reference to FIGS. 6A and 6B. Incidentally, the punch 70 is heated to a predetermined temperature by the heater 80 before press-forming as shown in FIG. 1.

Figure 6A:
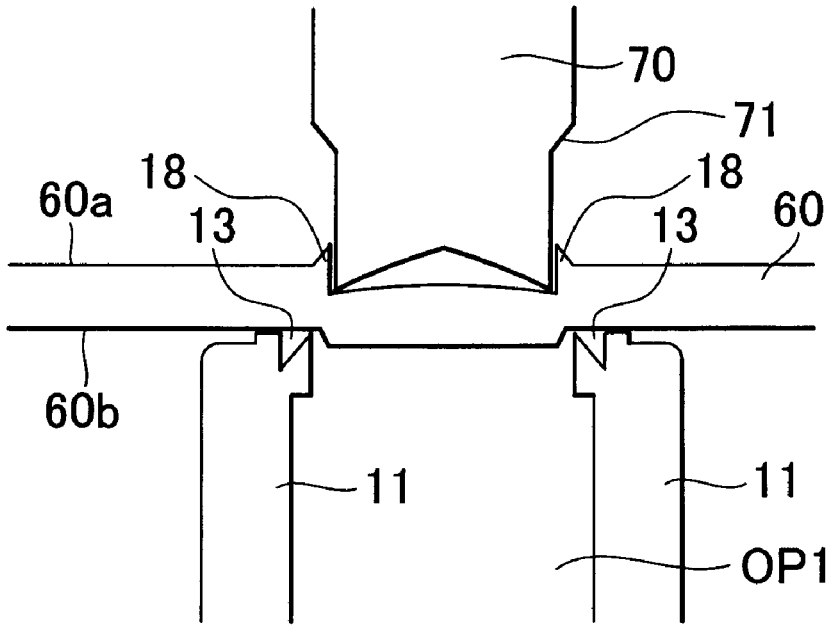
FIGS. 6A and 6B are views showing the state of a bumper fabricated by press-forming according to the first example embodiment of the invention.

As the punch 70 moves downward (toward the stage 50 side), the bumper 60 deforms, as shown in frame format in FIG. 6A. When this happens, a burr 18 forms on the upper surface 60*a* of the bumper 60. Incidentally, this burr 18 is a portion of the bumper 60 that protrudes upward as the bumper 60 deforms.

Figure 6B:
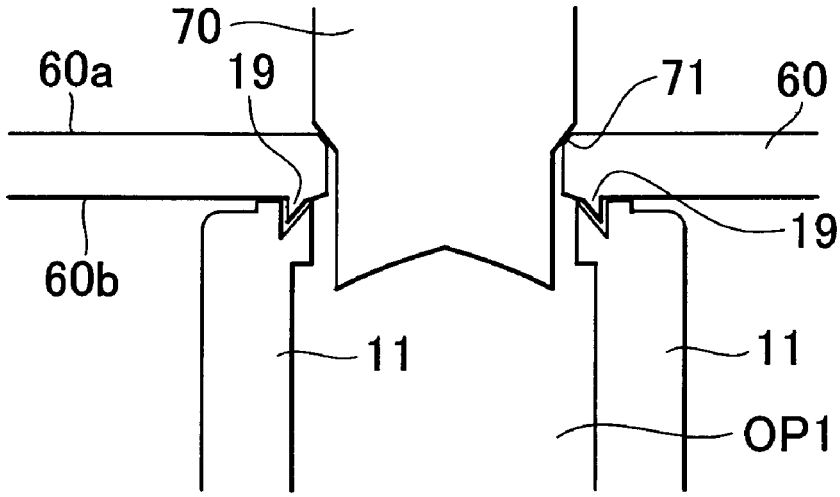

As the punch 70 moves further downward (toward the stage 50 side), part of the bumper 60 is punched out by the punch 70 such that an opening is formed in the bumper 60, as shown by the frame format in FIG. 6B. Also, as the punch 70 moves further downward, the pressing surface 71 of the punch 70 presses on the burr 18. Accordingly, the burr 18 on the upper surface 60*a* of the bumper 60 disappears and a burr 19 forms on the lower surface 60*b* of the bumper 60.

As described above, the concave portion 13 is formed in the upper surface 15 of the die 10. This concave portion 13 provides a space to receive the burr 19. Accordingly, the burr 19 preferably forms on the lower surface 60*b* of the bumper 60 in response to the pressure from the pressing portion 71 on the burr 18, and as a result, the burr 18 on the upper surface 60*a* of the bumper 60 disappears. Hence, it is possible to inhibit the aesthetics of the bumper 60 from being diminished as a result of press-forming.

In this way, in this example embodiment the burr 18 is inhibited from forming on the upper surface 60*a* of the bumper 60 by the concave portion 13 formed in the upper surface 15 of the die 10. As a result, it is possible to inhibit the aesthetics of the bumper 60 from being diminished as a result of press-forming.

Incidentally, the lower surface 60*b* of the bumper 60 is the surface on the vehicle body side of the vehicle so even if the burr 19 forms on the lower surface 60*b* of the bumper 60, it will not detract from the aesthetics of the bumper 60.

Also, burrs may also be inhibited from forming without pressing down on them with the pressing surface 71 by appropriately setting the size of the punch 70, the size of the opening OP1 of the die 10, and the thrust of the punch 70.

Figure 7:
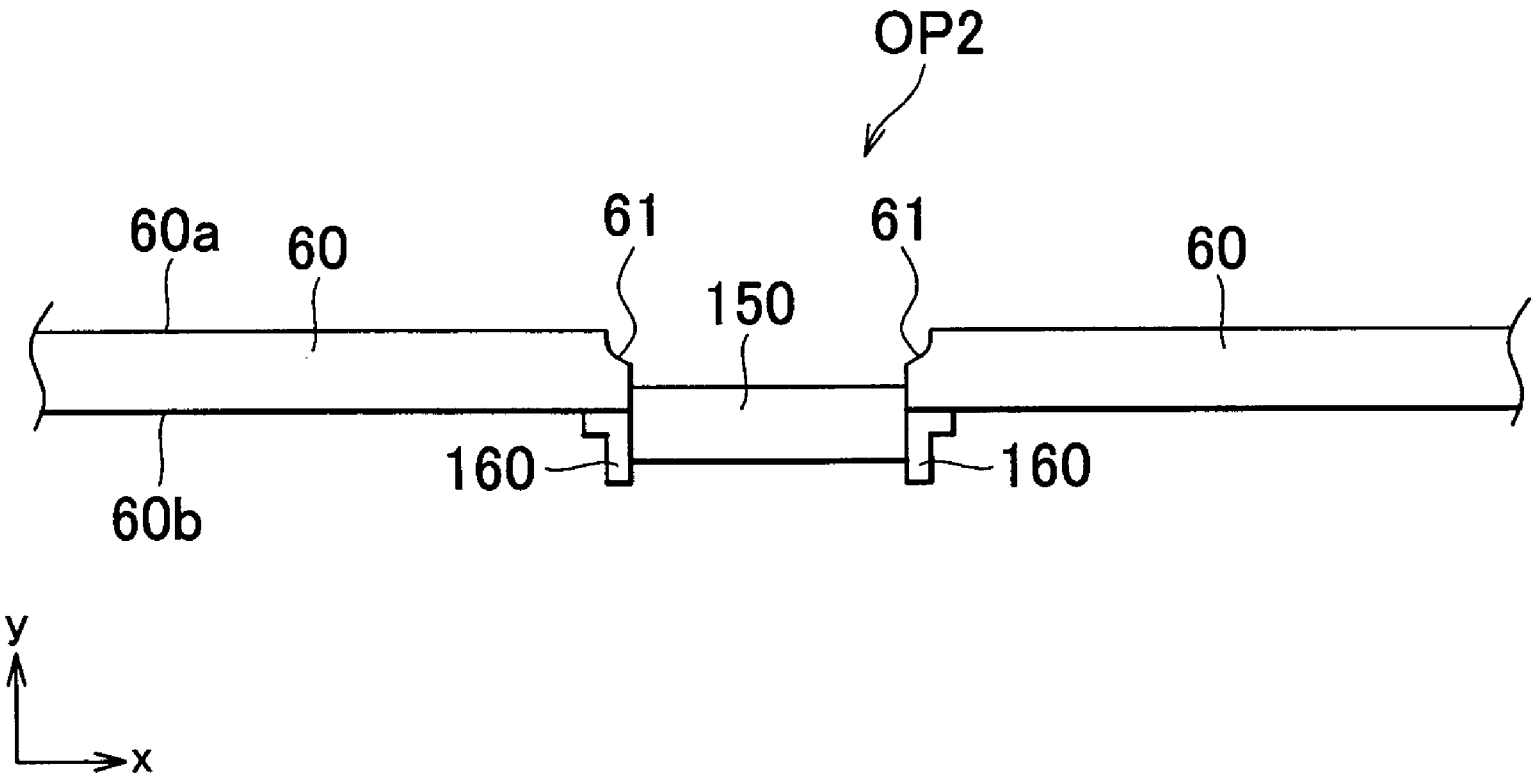
FIG. 7 is a view of the state of the bumper after sonar equipment has been mounted to it according to the first example embodiment of the invention.

Sonar equipment 150 is mounted via a mounting part 160 to an opening OP2 formed in the bumper 60, as shown in FIG. 7. Incidentally, the edge of the bumper 60 that defines the opening OP2 is dented from the pressure applied by the punch 70 to form a dent 61.

Figure 8:
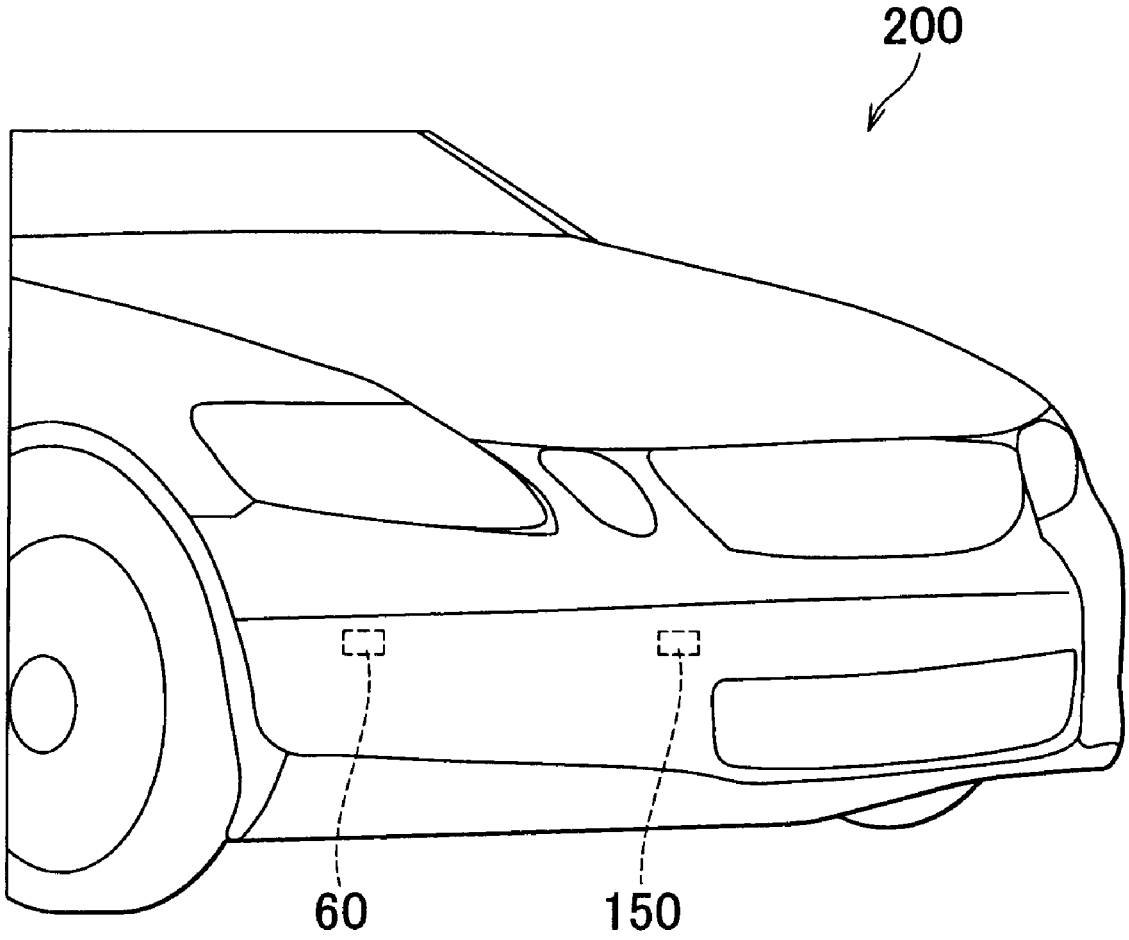
FIG. 8 is a view of a vehicle provided with the bumper according to the first example embodiment of the invention.

As shown by FIG. 8, the bumper 60 is mounted on a vehicle 200. The sonar equipment 150 is mounted to the bumper 60. Therefore the vehicle 200 is able to detect the distance to an obstacle based on output from the sonar equipment 150. As a result, the vehicle 200 is able to notify the driver of the vehicle 200 of the distance between the vehicle 200 and the obstacle. This enables the driver of the vehicle to safely maneuver the vehicle before reaching the obstacle, as well as enables the driver of the vehicle to avoid a collision with unexpected obstacles, for example.

Next, a second example embodiment of the invention will be described with reference to FIG. 9. The die 10 of this example embodiment has a different shape than the die 10 of the first example embodiment described above. The same effects as those obtained in the first example embodiment are also able to be obtained in this case. That is, the burr 18 is inhibited from forming on the upper surface 60*a* of the bumper 60 by the concave portion 13 formed in the upper surface 15 of the die 10. As a result, it is possible to inhibit the aesthetics of the bumper 60 from being diminished as a result of press-forming.

Figure 9:
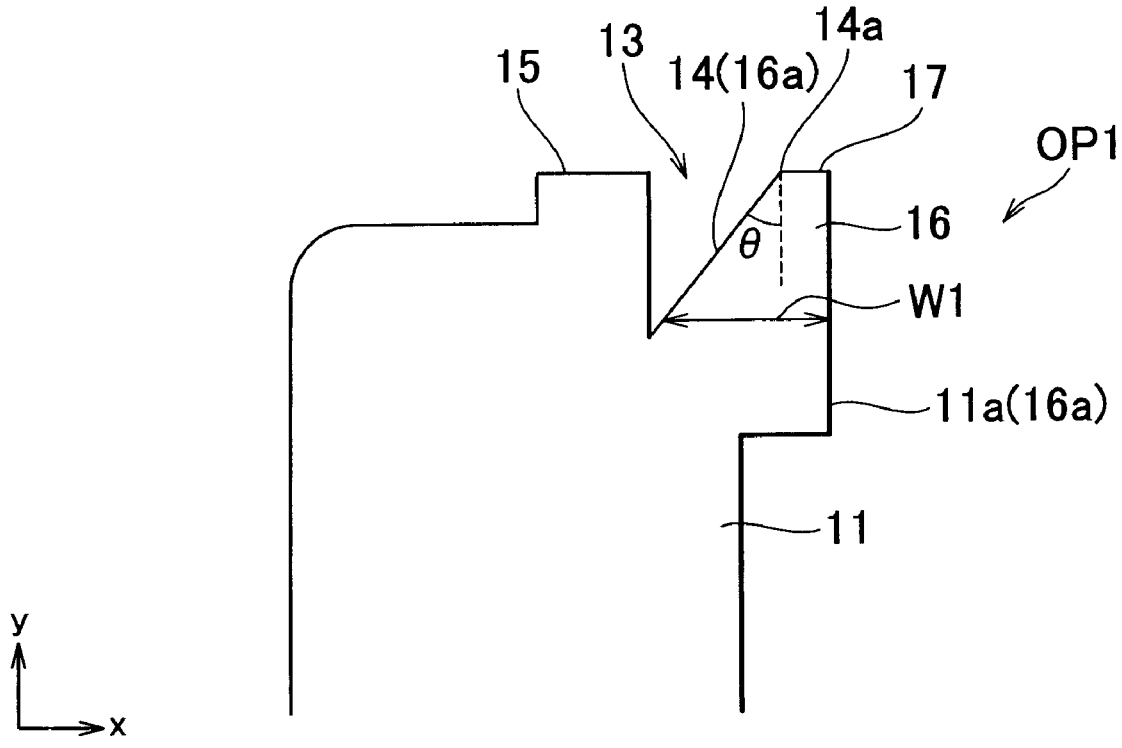
FIG. 9 is a detailed view showing a frame format of the structure of a die according to a second example embodiment of the invention.

As shown in FIG. 9, an upper surface 17 is formed between the concave portion 13 and the opening OP1. The bumper 60 is mounted (i.e., placed) on this upper surface 17 just as it is on the upper surface 15. In this case as well, the burr 19 described above is able to be received following press-forming in the concave portion 13 formed between the upper surface 15 and the upper surface 17. Therefore, the same effects obtained in the first example embodiment described above are also able to be obtained in this example embodiment. In other words, it is not necessary to provide the concave portion 13 such that the inner area 14*a* of the slanted surface 14 is connected to the inside surface 11*a* of the cylindrical portion 11.

In the example embodiment described above, the size and shape and the like of the concave portion 13 may be set appropriately. For example, they may be set according to the material and thickness and the like of the work (i.e., the bumper 60 in this example embodiment).

In the example embodiment described above, the inside surface 16*a* of the concave portion 13 may be formed flat, as shown in the drawing, or curved. Also, the surface need only be a generally slanted surface, and may be an uneven surface with many angles or a wavy surface.

Also, the shape and the inclination angle and the like of the opposing surface of the concave portion 13 that opposes the inside surface 16*a* may be determined as appropriate as long as the concave portion 13 in which the opposing surface and the inside surface 16*a* are able to receive the burr 19 is formed. For example, the opposing surface may also include a portion that is parallel with the upper surface 15 of the die 10.

Moreover, the inside surface 16*a* and the opposing surface may also be formed from a single surface (i.e., a curved surface).

Incidentally, the opening OP1 may be regarded as a first receiving portion of the invention, and the concave portion 13 may be regarded as a second receiving portion of the invention.

The invention is not limited to the example embodiments described above. The specific shape, material, and method of manufacturing of the die and punch may be determined as appropriate. The fabricated body is not limited to a part of a vehicle such as a bumper. Also, the invention is not limited to thermal press-forming.

While the invention has been described with reference to example embodiments thereof, it is to be understood that the invention is not limited to the described embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the spirit and scope of the invention.

What is claimed is:

1. A press-forming tool set comprising:

a die on which a fabricated body is mounted;

a punch that forms a hole in the fabricated body;

a mounting surface that is formed on the die and on which the fabricated body is mounted;

a first receiving portion which is formed in the die and at least partially receives the punch; and a second receiving portion which surrounds the first receiving portion is formed in the mounting surface and receives a deformed portion of the fabricated body that is outside of the hole and that is formed by the pressure of the punch on the fabricated body, the second receiving portion including a groove and a slanted surface that forms a part of the groove, and the groove being separated from the first receiving portion by a portion of the die, wherein the deformed portion is a burr, which is formed on a punch-facing side of the fabricated body and pressed to a die-facing side of the fabricated body into the second receiving portion, the punch has a pressing surface, and the pressing surface presses the deformed portion of the fabricated body into the second receiving portion.

2. The press-forming tool set according to claim 1, wherein:

the punch has a narrow width portion whose width is narrower than the width of an opening of the first receiving portion and which is received in the first receiving portion; and the punch has a thick width portion whose width is wider than the width of the opening of the first receiving portion and which is not received in the first receiving portion.

3. The press-forming tool set according to claim 1, wherein an inner area on the first receiving portion side of the slanted surface is connected to an inside surface of the die that forms the first receiving portion.

4. The press-forming tool set according to claim 1, wherein an angle formed by the slanted surface and an inside surface of the die is 30° to 60°, inclusive.

5. A press-forming method for forming a fabricated body using a die and a punch, comprising:

mounting the fabricated body on a mounting surface of the die;

pressing the fabricated body mounted on the die with the punch arranged in a position corresponding to a first receiving portion formed in the die to form a hole in the fabricated body; and receiving a deformed portion of the fabricated body, which is formed outside of the hole and which is formed by the pressure of the punch on the fabricated body, in a second receiving portion formed surrounding the first receiving portion in the mounting surface of the die, the second receiving portion including a groove and a slanted surface that forms a part of the groove, and the groove being separated from the first receiving portion by a portion of the die, wherein the deformed portion is a burr, which is formed on a punch-facing side of the fabricated body and pressed to a die-facing side of the fabricated body into the second receiving portion.

6. A method of manufacturing a bumper having a hole using a die and a punch, comprising:

mounting the bumper on a mounting surface of the die;

pressing the bumper mounted on the die with a punch arranged in a position corresponding to a first receiving portion formed in the die to form the hole in the bumper; and receiving a deformed portion of the bumper, which is formed outside of the hole and which is formed by the pressure of the punch on the bumper, in a second receiving portion formed surrounding the first receiving portion in the mounting surface of the die, the second receiving portion including a groove and a slanted surface that forms a part of the groove, and the groove being separated from the first receiving portion by a portion of the die, wherein the deformed portion is a burr, which is formed on a punch-facing side of the bumper and pressed to a die-facing side of the bumper into the second receiving portion.

* * * * *